US007473859B2

(12) United States Patent
Wright et al.

(10) Patent No.: US 7,473,859 B2
(45) Date of Patent: Jan. 6, 2009

(54) GATING VOLTAGE CONTROL SYSTEM AND METHOD FOR ELECTROSTATICALLY ACTUATING A MICRO-ELECTROMECHANICAL DEVICE

(75) Inventors: Joshua Isaac Wright, Arlington, VA (US); Kanakasabapathi Subramanian, Clifton Park, NY (US); William James Premerlani, Scotia, NY (US); John Norton Park, Rexford, NY (US); Christopher Keimel, Schenectady, NY (US); Long Que, Rexford, NY (US); Kuna Venkat Satya Rama Kishore, Bangalore (IN); Abhijeet Dinkar Sathe, Bangalore (IN); Xuefeng Wang, Schenectady, NY (US); Edward Keith Howell, Hendersonville, NC (US)

(73) Assignee: General Electric Company, Niskayuna, NY (US)

( * ) Notice: Subject to any disclaimer, the term of this patent is extended or adjusted under 35 U.S.C. 154(b) by 182 days.

(21) Appl. No.: 11/622,483

(22) Filed: Jan. 12, 2007

(65) Prior Publication Data

US 2008/0169707 A1 Jul. 17, 2008

(51) Int. Cl.
*H01H 51/22* (2006.01)

(52) U.S. Cl. ..... 200/181; 200/329

(58) Field of Classification Search ..... 200/181, 200/4, 175, 19.01, 19.02, 49, 51 R, 237, 239; 335/78

See application file for complete search history.

(56) References Cited

U.S. PATENT DOCUMENTS 6,917,268 B2 * 7/2005 Deligianni et al. ..... 335/78
6,977,569 B2 * 12/2005 Deligianni et al. ..... 335/78
7,061,660 B1 6/2006 Chen et al.

OTHER PUBLICATIONS

Leow Cheah Wei, Abu Bakar Mohammed, Norazan Mohd. Kassim; Analytical Modeling For Determination of Pull-In Voltage For An Electrostatic Actuated MEMS Cantilever Beam; ICSE2002 Proc. 2002, Penang, Malaysia; pp. 233-238.

* cited by examiner

*Primary Examiner*—David Hung Vu
(74) *Attorney, Agent, or Firm*—Jason K. Klindtworth

(57) ABSTRACT

A gating voltage control system and method are provided for electrostatically actuating a micro-electromechanical systems (MEMS) device, e.g., a MEMS switch. The device may comprise an electrostatically responsive actuator movable through a gap for actuating the device to a respective actuating condition corresponding to one of a first actuating condition (e.g., a closed switching condition) and a second actuating condition (e.g., an open switching condition). The gating voltage control system may comprise a drive circuit electrically coupled to a gate terminal of the device to apply a gating voltage. The gating voltage control system may further comprise a controller electrically coupled to the drive circuit to control the gating voltage applied to the gating terminal in accordance with a gating voltage control sequence. The gating voltage control sequence may comprise a first interval for ramping up the gating voltage to a voltage level for producing an electrostatic force sufficient to accelerate the actuator through a portion of the gap to be traversed by the actuator to reach a respective actuating condition. The gating voltage control sequence may further comprise a second interval for ramping down the gating voltage to a level sufficient to reduce the electrostatic force acting on the movable actuator. This allows reducing the amount of force at which the actuator engages a contact for establishing the first actuating condition, or avoiding an overshoot position of the actuator while reaching the second actuating condition.

18 Claims, 2 Drawing Sheets

GATING VOLTAGE CONTROL SYSTEM AND METHOD FOR ELECTROSTATICALLY ACTUATING A MICRO-ELECTROMECHANICAL DEVICE

FIELD OF THE INVENTION

The present invention is generally related to circuitry for actuating a micro-electromechanical systems (MEMS) device, and, more particularly, to a gating voltage control system and method for electrostatically actuating a MEMS switch.

BACKGROUND OF THE INVENTION

It is known to provide electrostatic actuation in micro-electromechanical systems (MEMS) devices that may include an actuator (e.g., a cantilever beam) responsive to such electrostatic actuation. For example, in MEMS switches the electrostatic actuation generally occurs by applying a voltage from a voltage source between a gate terminal and a source terminal in a three terminal device; or between the gate terminal and gate ground for four terminal devices. The actuation voltage can range from approximately 3V to approximately >100V and may be typically applied as a step function, or a realizable approximation of a step function.

For example, when the step function voltage is low (e.g., 0V), a normally open switch would remain open. When the step function voltage goes high (e.g., 100V), the switch would be closed to a conductive switching condition. The implementation of the control for the voltage source tends to be uncomplicated for this type of electrostatic actuation. Metaphorically speaking this would be analogous to accelerating a vehicle (e.g., cantilever beam) as fast as possible (no brakes applied) to reach a post (e.g., a switch contact).

It is also known that this form of electrostatic actuation (e.g., step function) may introduce undesirable effects either during a switch closing event or a switch opening event. For example, in a switch closing event, as the cantilever beam approaches the switch contact, the diminishing gap between the gate and cantilever decreases and causes an increase in the electrostatic force ($\propto 1/\text{gap}^2$) acting on the cantilever. As a result, the cantilever beam greatly accelerates as it approaches the contact and may impact the contact with a substantial force (e.g., high speed impact).

This high speed impact may have several consequences. First, after the initial high speed impact, the beam and/or contact may rebound (e.g., mechanical oscillation or bounce) before being driven by the actuation voltage to establish a continuous contact. This bouncing can occur one or more times before the beam finally settles. Some approaches to solve the high speed impact (and concomitant) bouncing have generally involved cumbersome and costly approaches that can affect the structural design of the MEMS device, e.g., changing the physical dimensions and/or material of the beam to make it stiffer, changing the atmosphere where the switch operates, using a dampening structure, etc. Other approaches have involved lowering the intensity of the actuation voltage to decrease the electrostatic force applied, (metaphorically speaking this may be conceptualized as not accelerating the vehicle as fast as feasible to the post). However, this tends to increase the switch actuation time to an unacceptable level. Another consequence of a high speed impact is a tendency to rapidly degrade the switch contacts over time. The number of operational cycles that a switch is rated to perform over its lifetime is often limited by the wearing of the contacts. For example, if the amount of physical impact on the colliding switch contacts could be reduced, then the amount of bounce would be reduced or eliminated and a substantial number of operational cycles could be added to the ratings of the switch.

Similarly, during a switch opening event, the cantilever beam tends to overshoot its neutral (e.g., normal) open position and may oscillate till it eventually reaches such neutral position. This oscillatory motion may create a varying standoff voltage during the opening event. An oscillatory movement means that even after the MEMS switch has opened and a nominal rated voltage standoff has been reached, it is possible for the switch (e.g., cantilever position) to momentarily fall below its rated standoff voltage one or more times before finally settling at the neutral position and permanently meeting the nominal value for voltage standoff. During a moment when the switch falls below its rated standoff voltage, this may cause the voltage standoff to be less than the required dielectric isolation with respect to the source (load) voltage and may lead to an undesirable arcing (voltage breakdown) condition, or to a momentary re-closure due to electrostatic attraction.

In view of the foregoing considerations, there is a need for an improved electrostatic control. For example, it would be desirable to provide a system and/or techniques for appropriately adjusting (shaping) the gate actuation voltage to reduce the impact of the collision of the cantilever beam in a MEMS device (e.g., a switch) (or reduce oscillatory movement (e.g., overshoot) of the cantilever beam during a switch opening event) without substantially reducing the actuation time of the switch.

BRIEF DESCRIPTION OF THE INVENTION

Generally, in one aspect thereof, the present invention provides a gating voltage control system for electrostatically actuating a micro-electromechanical systems (MEMS) switch. The switch may comprise an electrostatically responsive actuator movable through a gap for actuating the switch to a respective switching condition corresponding to one of a closed switching condition and an open switching condition. The control system comprises a drive circuit electrically coupled to a gate terminal of the switch to apply a gating voltage. The control system further comprises a controller electrically coupled to the drive circuit to control the gating voltage applied to the gating terminal in accordance with a gating voltage control sequence. The gating voltage control sequence may comprise a first interval for ramping up the gating voltage to a voltage level for producing an electrostatic force sufficient to accelerate the actuator through a portion of the gap to be traversed by the actuator to reach a respective switching condition. The gating voltage control sequence may further comprise a second interval for ramping down the gating voltage to a level sufficient to reduce the electrostatic force acting on the movable actuator. This allows reducing the amount of force at which the actuator engages a switch contact for establishing a closed switching condition, or avoiding an overshoot position of the actuator while reaching an open switching condition.

In another aspect thereof, the present invention provides a gating voltage control system for electrostatically actuating a micro-electromechanical systems (MEMS) device. The device may comprise an electrostatically responsive actuator movable through a gap for actuating the device to a respective actuating condition corresponding to one of a first actuating condition and a second actuating condition. The gating voltage control system may comprise a drive circuit electrically coupled to a gate terminal of the device to apply a gating voltage. The gating voltage control system may further comprise a controller electrically coupled to the drive circuit to control the gating voltage applied to the gating terminal in accordance with a gating voltage control sequence. The gating voltage control sequence may comprise a first interval for ramping up the gating voltage to a voltage level for producing an electrostatic force sufficient to accelerate the actuator through a portion of the gap to be traversed by the actuator to reach a respective actuating condition. The gating voltage control sequence may further comprise a second interval for ramping down the gating voltage to a level sufficient to reduce the electrostatic force acting on the movable actuator. This allows reducing the amount of force at which the actuator engages a contact for establishing the first actuating condition, or avoiding an overshoot position of the actuator while reaching the second actuating condition.

BRIEF DESCRIPTION OF THE DRAWINGS

The invention is explained in the following description in view of the drawings that show.

DETAILED DESCRIPTION OF THE INVENTION

Figure 1:
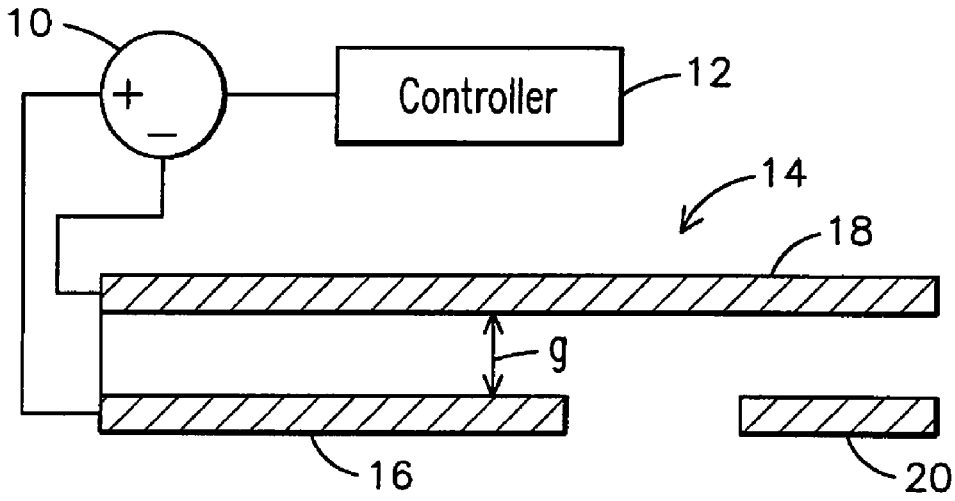
FIG. 1 is a schematic view of a gating voltage control system as may be configured to perform electrostatic actuation in accordance with aspects of the present invention of a MEMS device.

In accordance with embodiments of the present invention, structural and/or operational relationships, as may be used to provide gating voltage control (e.g., to meet a desired switching condition), such as for a switching array based on micro-electromechanical systems (MEMS) switches are described herein. Presently, MEMS generally refer to micron-scale structures that for example can integrate a multiplicity of functionally distinct elements, e.g., mechanical elements, electromechanical elements, sensors, actuators, and electronics, on a common substrate through micro-fabrication technology. It is contemplated, however, that many techniques and structures presently available in MEMS devices will in just a few years be available via nanotechnology-based devices, e.g., structures that may be smaller than 100 nanometers in size. Accordingly, even though example embodiments described throughout this document may refer to MEMS-based devices, it is submitted that the inventive aspects of the present invention should be broadly construed and should not be limited to micron-sized devices.

In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply that these operations need be performed in the order they are presented, nor that they are even order dependent. Moreover, repeated usage of the phrase "in one embodiment" does not necessarily refer to the same embodiment, although it may. Lastly, the terms "comprising", "including", "having", and the like, as used in the present application, are intended to be synonymous unless otherwise indicated.

The inventors of the present invention have innovatively recognized system and/or techniques for selectively adjusting a gating voltage for electrostatically actuating a movable actuator (e.g., a cantilever beam type of actuator) in a micro-electromechanical systems (MEMS) device, such as a switch. For example, during a switch closing event, adjusting the gating voltage in accordance with aspects of the present invention may allow to provide a cushioning effect on the switch contacts. Conversely, during a switch opening event, adjusting the gating voltage in accordance with aspects of the present invention may allow to reduce oscillatory movement (e.g., overshoot position) of the cantilever beam.

FIG. 1 is a schematic view of a gating voltage control system as may include a gate driver 10 responsive to a controller 12 configured to perform electrostatic actuation of a MEMS switch 14 in accordance with aspects of the present invention. The electrostatic actuation may be performed by applying a suitably configured gating voltage applied by gate driver 10, for example, between a gate terminal 16 and a source terminal 18 (e.g., cantilever beam) in a three terminal device; or between the gate terminal and gate ground for four terminal devices. FIG. 1 illustrates an open three terminal switch condition. Once the movable beam has been actuated to a closed condition, at least a segment of cantilever beam 18 will be physically touching a drain terminal 20 (e.g., switch contact) of the MEMS switch.

Figure 2:
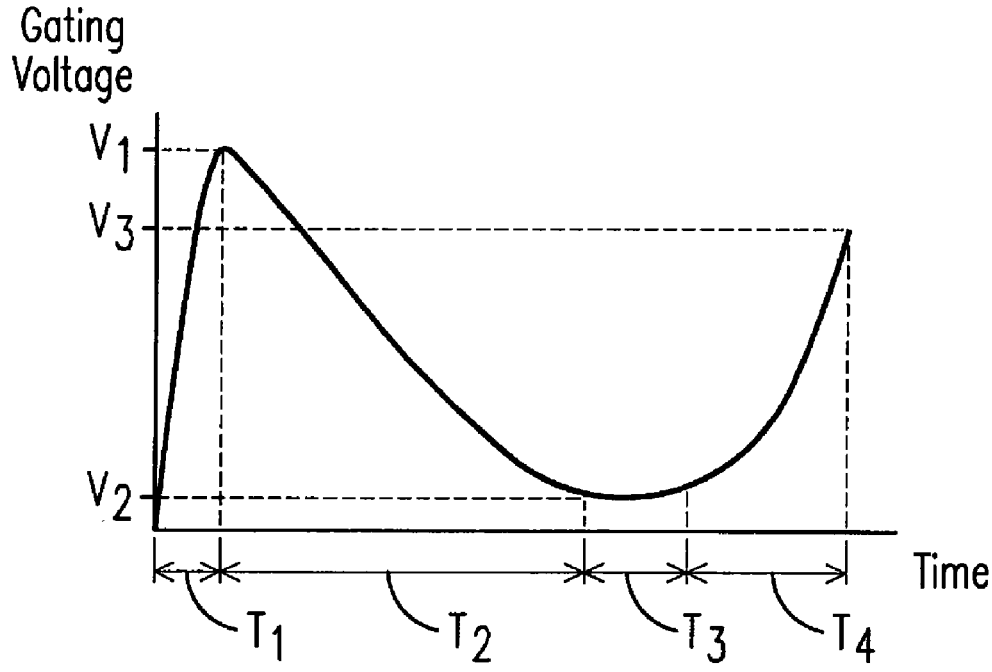
FIG. 2 is a plot of one example embodiment of a waveform of a gating voltage as may be configured to electrostatically actuate in accordance with aspects of the present invention a MEMS device.

FIG. 2 is a plot of one example embodiment of a waveform of a gating voltage (i.e., vertical axis) as may be configured to electrostatically actuate in accordance with aspects of the invention a MEMS switch. For purposes of explanation of illustrative guiding principles, the plot may be sub-divided into a sequence of intervals (e.g., four) along the time axis (i.e., horizontal axis). It will be understood that such example intervals as graphically portrayed in FIG. 2 are not meant to rigidly categorize aspects of the present invention since in a practical implementation any of such intervals may be emphasized (or deemphasized) to a higher or to a lesser degree depending on the requirements of a given application.

Interval T1: In this initial interval, the gating voltage may be selected to provide a rapid rate of rise voltage. This allows imparting sufficient energy to the cantilever beam to gain acceleration and traverse the gap (labeled with the letter g). In one example embodiment, the magnitude (labeled as voltage V1) of the gating voltage may be selected sufficiently high provided such magnitude is kept within a value for avoiding a gap voltage breakdown. In one example embodiment, the duration of interval T1 may be in the order of a couple of 100's of nanoseconds to ensure sufficient momentum is provided to overcome the spring force acting on the cantilever. As will be appreciated by one skilled in the art, the magnitude V1 for the gating voltage can be selected based on the size (e.g., mass) and stiffness of the cantilever and the gap at the gate. In this manner one can impart cantilever beam movement proportionate to the size of the beam.

Interval T2: In this example interval, the gating voltage may be selected to ramp down at a rate sufficiently fast to allow the cantilever to coast. This rate may be analytically estimated (or experimentally derived) and then programmed in controller 12. It will be appreciated that if one establishes in the time domain a suitable relationship between cantilever dynamics (e.g., movement) and gate actuation, then the position of the cantilever in the gap as a function of time may be estimated.

Interval T3: The ramping down of gating voltage may be terminated upon reaching a predetermined voltage (labeled as voltage V2). The value of voltage V2 may be chosen to hold the tip of the cantilever beam just slightly above the drain. In one example embodiment, this hold voltage V2 may be applied for the duration of interval T3 such that essentially every cantilever in a MEMS switching array has the ability to substantially uniformly relax and stabilize its respective position in the gap just slightly above the drain contact. The time duration for applying hold voltage V2 may be in the order of a few nanoseconds depending on an average relaxation time of the cantilevers in the MEMS switching array. Once again, parameters such as the value of hold voltage V2 and the time duration for applying hold voltage V2 may be analytically estimated (or experimentally derived) and programmed in controller 12.

Interval T4: Once essentially every cantilever position is a substantially stabilized condition, e.g., positioned just slightly above the switch contact, the gating voltage can be ramped up to a voltage value (labeled V3) for establishing contact with the drain terminal. The magnitude of close voltage V3 may be chosen based on a desired amount of contact pressure.

It is contemplated that since every cantilever will have traversed the gap in response to a gating voltage configured to provide a controlled speed and force, then the amount of bouncing will be eliminated or substantially reduced. Moreover, by choosing an appropriate value for the close voltage V3, the contact pressure can be tailored for a relatively low contact resistance regime.

The foregoing voltage gating control comprises an open loop control and it is envisioned that in operation will reduce variation of closing time for the plurality of cantilever beams that make up a MEMS switching array while maintaining a relatively fast actuation times, and consistently establishing an appropriate contact pressure without bouncing. It will be appreciated that a voltage gating control embodying aspects of the present invention may be adapted to perform a closed loop control. For example, a suitable sensor (e.g., a capacitance-based sensor, a tunneling current-based sensor, etc.) may be used for monitoring cantilever motion (e.g., position, speed) and this information may be supplied to the controller to adjust the gating signal accordingly. In one example embodiment, it is expected that a total actuation time for a sequence of intervals, such as T1+T2+T3+T4 may be in the order of 5 microseconds.

Figure 3:
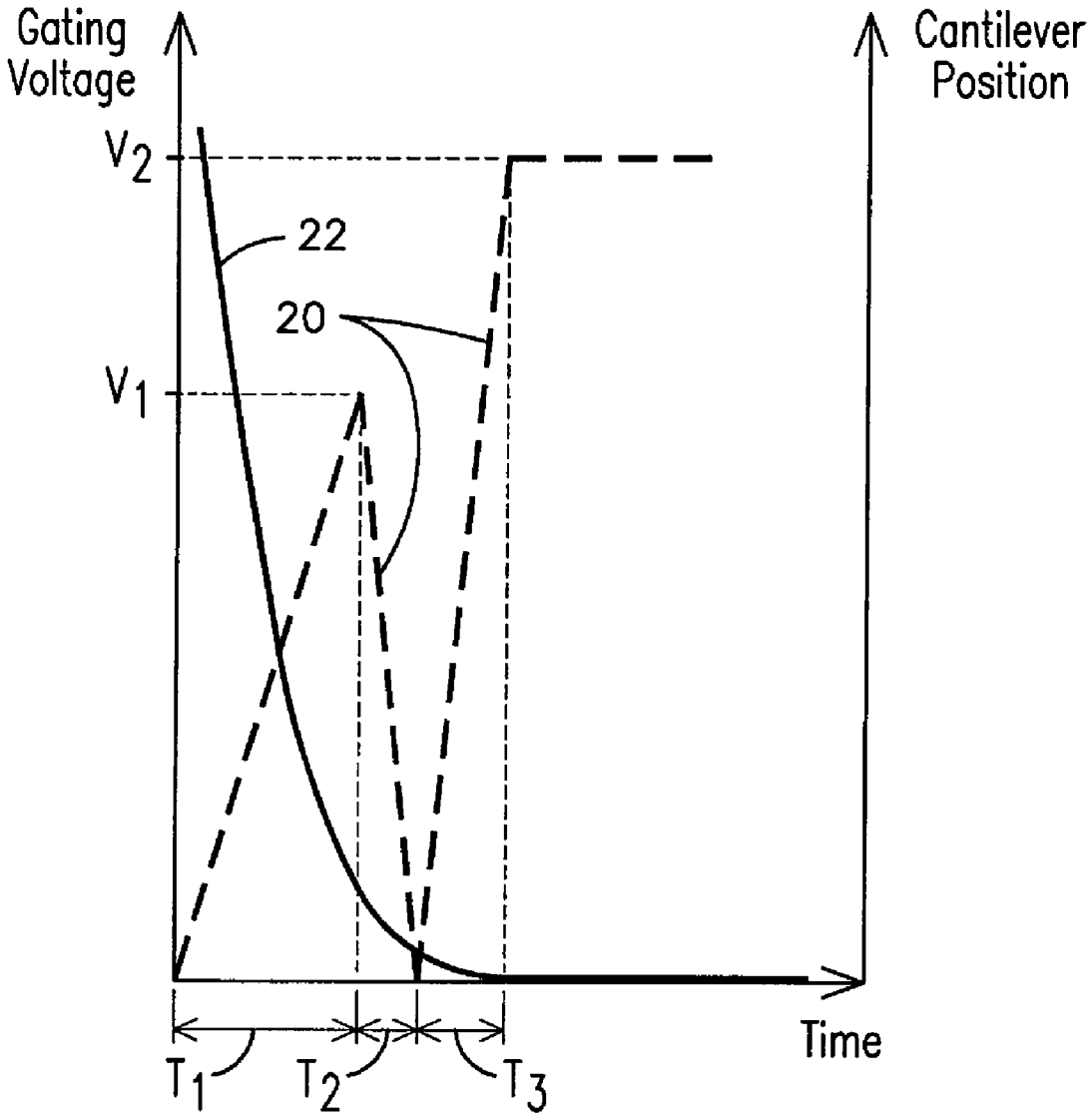
FIG. 3 is a plot of another example embodiment of a waveform of a gating voltage in accordance with aspects of the present invention.

FIG. 3 is a plot of another example embodiment of a waveform of a gating voltage 20, plotted as a function of time, as may be configured to electrostatically actuate in accordance with aspects of the invention a MEMS switch. FIG. 3 further illustrates a plot of cantilever position 22, also plotted as a function of time. As shown in FIG. 3, in example interval T1, the gating voltage may be selected to provide a rapid rate of rise voltage to a voltage level V1. This allows imparting sufficient energy to the cantilever beam to gain acceleration. At some predetermined time prior to occurrence of a collision with the switch contact, the gating voltage is ramped down (e.g., turned off) during example interval T2 as the cantilever continues to approach the switching contact essentially in a non-accelerating manner (e.g., coasting). In example interval T3, after an initial contact by the cantilever beam is made (or just prior to such contact having been made), the gating voltage would be reapplied to reach a hold voltage V2 configured to maintain (or establish) such initial contact. It is expected that this gating voltage control would similarly avoid a high speed collision of the cantilever beam and the switch contact since the accelerating effects of the electrostatic force would be diminished (e.g., by turning off the gate voltage during the T2 interval) and would allow the switch contacts to make a relatively soft initial contact primarily driven by the inertial force acting on the beam. The gating voltage would then be reapplied to create a strong contact and would keep the contacts from reopening under the spring forces of the beam. In operation this technique would similarly keep the contacts from bouncing at impact.

As will be appreciated by those skilled in the art, the accelerating force on the cantilever beam is the vector sum of the electrostatic force and the spring force. Since spring force is zero in the rest position, then the initial force is entirely due to the gate voltage. However, electrostatic force is both a function of gate-to-source voltage (V^2) and inversely to the gap distance (d^2) between gate and source. Hence, as the beam moves closer to the gate, the electrostatic force increases based on a square-law relationship, but the spring force increases linearly. Therefore, electrostatic energy is being put into the spring as well as into kinetic energy of the beam. As described above, at some point, the voltage is reduced and this allows the spring to absorb much of the kinetic energy of the beam, such as nearly stopping beam motion just prior to contact with the stationary contact (drain). As beam and drain touch, the applied voltage may increased at a rate fast enough to overcome elastic bounce force, and high enough to hold the contacts together at a sufficiently low resistance. In opening, the applied voltage needs to absorb the kinetic energy of the beam, which is virtually equal to the energy that had been stored in the spring, rapidly as the beam approaches a quiescent position. This is generally known to provide a critical damping to oscillatory systems, and, in one example embodiment, a damping that allows approximately a 10% overshoot may provide a relatively fast recovery of standoff voltage, without a transiently reduced gap.

While various embodiments of the present invention have been shown and described herein, it is noted that such embodiments are provided by way of example only. Numerous variations, changes and substitutions may be made without departing from aspects of the invention herein. Accordingly, it is intended that the invention be limited only by the spirit and scope of the appended claims.

The invention claimed is:

1. A gating voltage control system for electrostatically actuating a micro-electromechanical systems switch, wherein the switch comprises an electrostatically responsive actuator movable through a gap for actuating the switch to a respective switching condition corresponding to one of a closed switching condition and an open switching condition, said gating voltage control system comprising:

a drive circuit electrically coupled to a gate terminal of the switch to apply a gating voltage; and a controller electrically coupled to the drive circuit to control the gating voltage applied to the gating terminal in accordance with a gating voltage control sequence, wherein the gating voltage control sequence comprises a first interval for ramping up the gating voltage to a voltage level for producing an electrostatic force sufficient to accelerate the actuator through a portion of the gap to be traversed by the actuator to reach a respective switching condition, the gating voltage control sequence further comprising a second interval for ramping down the gating voltage to a level sufficient to reduce the electrostatic force acting on the movable actuator, thereby reducing the amount of force at which the actuator engages a switch contact for establishing a closed switching condition, or avoiding an overshoot position of the actuator while reaching an open switching condition.

2. The control system of claim 1 wherein the gating voltage control sequence further comprises a third interval for ramping up the gating voltage to a voltage level for producing an electrostatic force sufficient to maintain a desired amount of mechanical pressure between the actuator and the switch contact upon the actuator engaging the switch contact for establishing the closed switching condition.

3. The control system of claim 1 wherein the actuator comprises a cantilever beam.

4. The control system of claim 3 wherein the micro-electromechanical systems switch comprises an array of micro-electromechanical systems switches.

5. The control system of claim 1 wherein the gating voltage reached during the second interval is applied for a period of time sufficiently long to allow respective cantilever beams of the switching array to stabilize their respective positions with respect to one another in the gap prior to engaging a plurality of corresponding switch contacts.

6. The control system of claim 1 wherein said controller is configured as an open loop controller.

7. The control system of claim 1 wherein said controller is coupled to monitor cantilever motion as the cantilever moves through the gap for actuating the switch to a respective switching condition, and further wherein said controller is configured to perform a closed loop gating voltage control sequence based at least on the monitored cantilever motion.

8. A gating voltage control system for electrostatically actuating a micro-electromechanical systems device, wherein the device comprises an electrostatically responsive actuator movable through a gap for actuating the device to a respective actuating condition corresponding to one of a first actuating condition and a second actuating condition, said control system comprising:

a drive circuit electrically coupled to a gate terminal of the device to apply a gating voltage; and a controller electrically coupled to the drive circuit to control the gating voltage applied to the gating terminal in accordance with a gating voltage control sequence, wherein the gating voltage control sequence comprises a first interval for ramping up the gating voltage to a voltage level for producing an electrostatic force sufficient to accelerate the actuator through a portion of the gap to be traversed by the actuator to reach a respective actuating condition, the gating voltage control sequence further comprising a second interval for ramping down the gating voltage to a level sufficient to reduce the electrostatic force acting on the movable actuator, thereby reducing the amount of force at which the actuator engages a contact for establishing the first actuating condition, or avoiding an overshoot position of the actuator while reaching the second actuating condition.

9. The control system of claim 8 wherein the gating voltage control sequence further comprises a third interval for ramping up the gating voltage to a voltage level for producing an electrostatic force sufficient to maintain a desired amount of mechanical pressure between the actuator and the contact upon the actuator engaging the contact for establishing the first actuating condition.

10. The control system of claim 8 wherein the micro-electromechanical systems device comprises a micro-electromechanical systems switch, wherein the actuator comprises a cantilever beam, and wherein the first actuating condition comprises a closed switching condition and the second actuating condition comprises an open switching condition.

11. The control system of claim 10 wherein the micro-electromechanical systems switch comprises an array of micro-electromechanical systems switches.

12. The control system of claim 11 wherein the gating voltage reached during the second interval is applied for a period of time sufficiently long to allow respective cantilever beams of the switching array to stabilize their respective positions with respect to one another in the gap prior to engaging a plurality of corresponding switch contacts.

13. The control system of claim 8 wherein said controller is configured as an open loop controller.

14. The control system of claim 8 wherein said controller is coupled to monitor cantilever motion as the cantilever moves through the gap for actuating the switch to a respective switching condition, and further wherein said controller is configured to perform a closed loop gating voltage control sequence based at least on the monitored cantilever motion.

15. A gating voltage control method for electrostatically actuating a micro-electromechanical systems switch, wherein the switch comprises an electrostatically responsive actuator movable through a gap for actuating the switch to a respective switching condition corresponding to one of a closed switching condition and an open switching condition, said method comprising:

applying a gating voltage to a gate terminal of the switch;

controlling the gating voltage applied to the gating terminal in accordance with a gating voltage control sequence, wherein the gating voltage control sequence comprises:

ramping up the gating voltage to a voltage level for producing an electrostatic force sufficient to accelerate the actuator through a portion of the gap to be traversed by the actuator to reach a respective switching condition; and ramping down the gating voltage to a level sufficient to reduce the electrostatic force acting on the movable actuator, thereby reducing the amount of force at which the actuator engages a switch contact for establishing a closed switching condition, or avoiding an overshoot position of the actuator while reaching an open switching condition.

16. The method of claim 15 wherein the gating voltage control sequence further comprises performing subsequent to the ramping down step a ramping up of the gating voltage to a voltage level for producing an electrostatic force sufficient to maintain a desired amount of mechanical pressure between the actuator and the switch contact upon the actuator engaging the switch contact for establishing a closed switching condition.

17. The method of claim 15 further comprising applying the gating voltage level reached during the ramping down step for a period of time sufficiently long to allow respective cantilever beams of the switching array to relax and stabilize their respective positions with respect to one another in the gap prior to engaging a plurality of corresponding switch contacts.

18. The method of claim 15 further comprising monitoring cantilever motion as the cantilever moves through the gap for actuating the switch to a respective switching condition, and further performing a closed loop gating voltage control sequence based at least on the monitoring of cantilever motion.

* * * * *